US009677379B2

(12) United States Patent
Mailand

(10) Patent No.: US 9,677,379 B2
(45) Date of Patent: Jun. 13, 2017

(54) COMPLETION, METHOD OF COMPLETING A WELL, AND A ONE TRIP COMPLETION ARRANGEMENT

(71) Applicant: Jason C. Mailand, The Woodlands, TX (US)

(72) Inventor: Jason C. Mailand, The Woodlands, TX (US)

(73) Assignee: BAKER HUGHES INCORPORATED, Houston, TX (US)

( * ) Notice: Subject to any disclaimer, the term of this patent is extended or adjusted under 35 U.S.C. 154(b) by 609 days.

(21) Appl. No.: 14/103,119

(22) Filed: Dec. 11, 2013

(65) Prior Publication Data

US 2015/0159468 A1 Jun. 11, 2015

(51) Int. Cl.

| | |
|---|---|
| ***E21B 34/14*** | (2006.01) |
| ***E21B 43/114*** | (2006.01) |
| ***E21B 43/26*** | (2006.01) |
| ***E21B 34/06*** | (2006.01) |
| *E21B 34/00* | (2006.01) |

(52) U.S. Cl.

CPC ..... *E21B 34/14* (2013.01); *E21B 34/063* (2013.01); *E21B 43/114* (2013.01); *E21B 43/26* (2013.01); *E21B 2034/005* (2013.01)

(58) Field of Classification Search

CPC ..... E21B 43/14; E21B 43/114; E21B 43/26

See application file for complete search history.

(56) References Cited

U.S. PATENT DOCUMENTS

| | | | |
|---|---|---|---|
| 3,264,994 | A | 8/1966 | Leutwyler |
| 6,772,842 | B2 | 8/2004 | Read et al. |
| 7,350,582 | B2 | 4/2008 | McKeachnie et al. |
| 7,464,764 | B2 | 12/2008 | Xu |
| 7,647,964 | B2 | 1/2010 | Akbar et al. |
| 7,686,076 | B2 | 3/2010 | York et al. |
| 7,798,236 | B2 | 9/2010 | McKeachnie et al. |
| 7,909,102 | B1 | 3/2011 | Hernandez et al. |
| 2001/0007284 | A1 | 7/2001 | French et al. |
| 2004/0129433 | A1 | 7/2004 | Krawiec et al. |
| 2010/0101803 | A1 | 4/2010 | Clayton et al. |
| 2012/0085548 | A1* | 4/2012 | Fleckenstein ..... E21B 34/063 166/373 |

(Continued)

FOREIGN PATENT DOCUMENTS

| | | | |
|---|---|---|---|
| CA | 2528130 | A1 | 9/2006 |
| CA | 2746171 | A1 | 1/2013 |

(Continued)

OTHER PUBLICATIONS

Janz, et al.; "Single-Trip Perforate and Frac-Pack COmpletion with High-Efficiency Frac Gel in Bonga Phase II"; SPE 128049; SPE International Symposium; Lafettte, Louisiana, USA; Feb. 10-12, 2010; 12 pages.

(Continued)

*Primary Examiner* — Robert E Fuller

(74) *Attorney, Agent, or Firm* — Cantor Colburn LLP

(57) ABSTRACT

A method of completing a well includes, positioning at least one valve within a tubular, closing the at least one valve, pressuring up against the closed at least one valve in a first direction, actuating a tool or treating a formation, opening the at least one valve without intervention, and flowing fluid past the at least one valve in a second direction.

11 Claims, 4 Drawing Sheets

(56) References Cited

U.S. PATENT DOCUMENTS

| | | | |
|---|---|---|---|
| 2013/0014941 | A1 | 1/2013 | Tips et al. |
| 2015/0114664 | A1 | 4/2015 | Hulsewe et al. |

FOREIGN PATENT DOCUMENTS

| | | | |
|---|---|---|---|
| WO | 0043634 | A2 | 7/2000 |
| WO | 2004031532 | A1 | 4/2004 |

OTHER PUBLICATIONS

Vickery, et al.; SPE 64469, "Application of One-Trip Multi-Zone Gravel Pack to Maximize Completion Efficiency"; SPE Asia Pacific Oil/Gas Conf, Brisbane, Australia; Oct. 16-18, 2000; 10 pages.

Watson, et al.; "One-Trip Multistage Completion Technology for Unconventional Gas Formations,"; CIPC/SPE Gas Tech Symposium, Calgary, Canada; Jun. 16-19, 2008; 14 pages.

Notification of Transmittal of the International Search Report and the Written Opinion of the International Searching Authority, or the Declaration; PCT/US2014/065147; Mailed Feb. 12, 2015; 10 Pages.

Schatz et al., "Multiple Radial Fracturing from a Wellbore—Experimental and Theoretical Results", 28th US Symposium on Rock Mechanics; Jun. 29-Jul. 1, 1987; 10 pages.

Houser et al., "Pinpoint Fracturing Using a Multiple-Cutting Process"; SPE 122949; Society of Petroleum Engineers; 2009 SPE Rockly Mountain Petroleum Technology Conference; Apr. 14-16, 2009; 10 pages.

* cited by examiner

COMPLETION, METHOD OF COMPLETING A WELL, AND A ONE TRIP COMPLETION ARRANGEMENT

BACKGROUND

Prior to completion of an earth formation borehole, such as are commonly employed in the hydrocarbon recovery and carbon dioxide sequestration industries, operations typically include running and setting plugs within the borehole. Such operations may include perforating and fracing, for example. After these operations are finished the plugs need to be removed so as not to create an obstruction to flow therepast in one or more directions. Removal often requires drilling or milling out of the plugs. The industry is always interested in systems and methods to avoid or decrease the costs associated with the time, equipment and manpower needed to perform the milling or drilling operation.

BRIEF DESCRIPTION

Disclosed herein is a method of completing a well. The method includes, positioning at least one valve within a tubular, closing the at least one valve, pressuring up against the closed at least one valve in a first direction, actuating a tool or treating a formation, opening the at least one valve without intervention, and flowing fluid past the at least one valve in a second direction.

Further disclosed herein is a completion. The completion includes a tubular, and at least one valve in operable communication with the tubular configured to initially provide no restriction to flow or intervention that is subsequently closable to fluid in a first direction sufficiently to allow actuation of a tool or treatment of a formation while allowing fluid therepast in a second direction. The at least one valve is also openable to flow therepast in the first direction without intervention after a period of time.

Further disclosed herein is a one trip completion arrangement. The arrangement includes a plurality of valves positioned within a borehole each configured to close to downhole flow once shifted for at least a duration of time and to allow uphole flow regardless of whether shifted, and a multi-tool configured to separately shift each of the plurality of valves and repeatedly perforate a lining of the borehole to allow fracing through the perforated lining with pressure built against one or more of the shifted and closed valves, such that a plurality of separate zones can be fraced and the borehole open to production upon a single trip of the multi-tool.

BRIEF DESCRIPTION OF THE DRAWINGS

The following descriptions should not be considered limiting in any way. With reference to the accompanying drawings, like elements are numbered alike.

DETAILED DESCRIPTION

Figure 1:
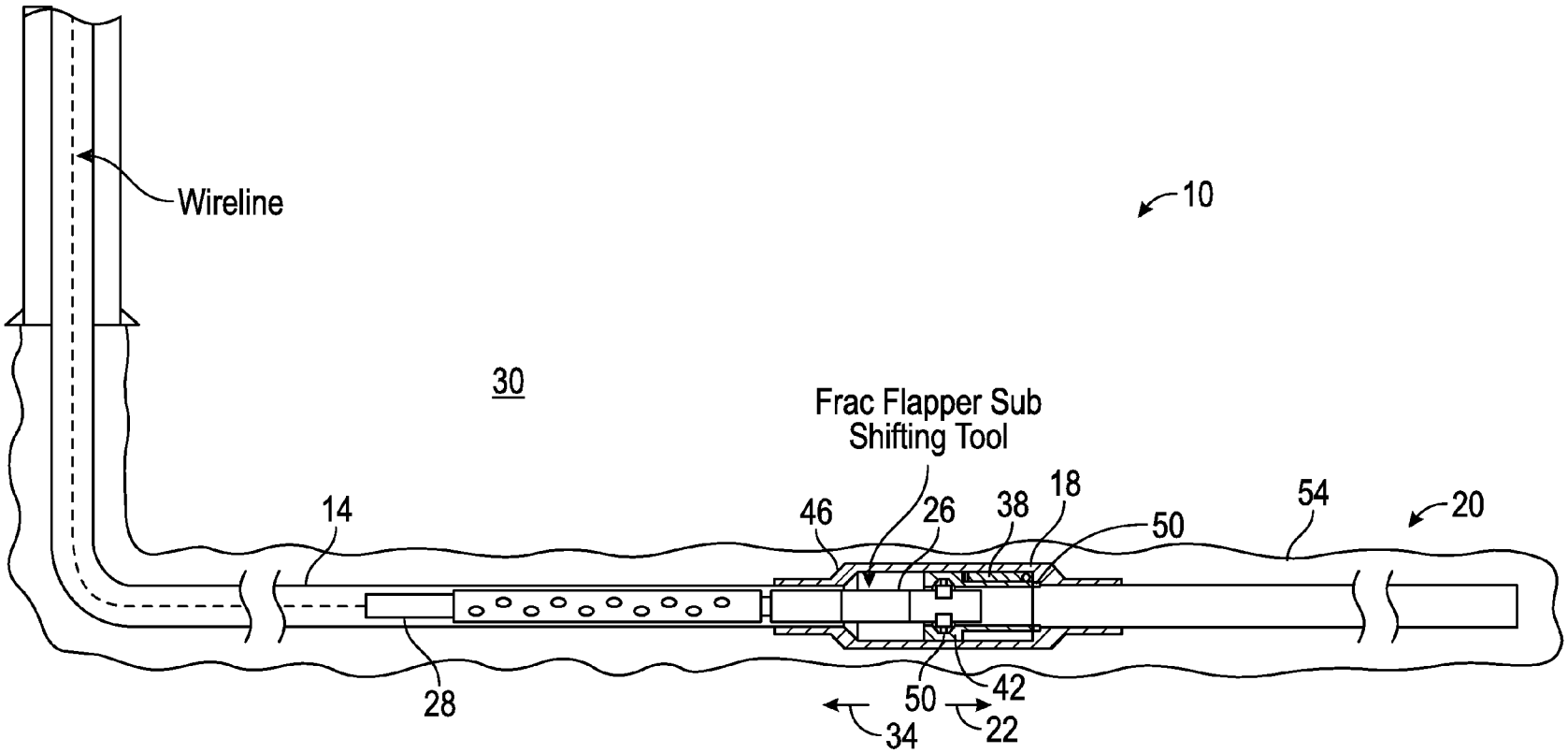
FIG. 1 depicts a schematical cross sectional view of a completion disclosed herein.
Figure 2:
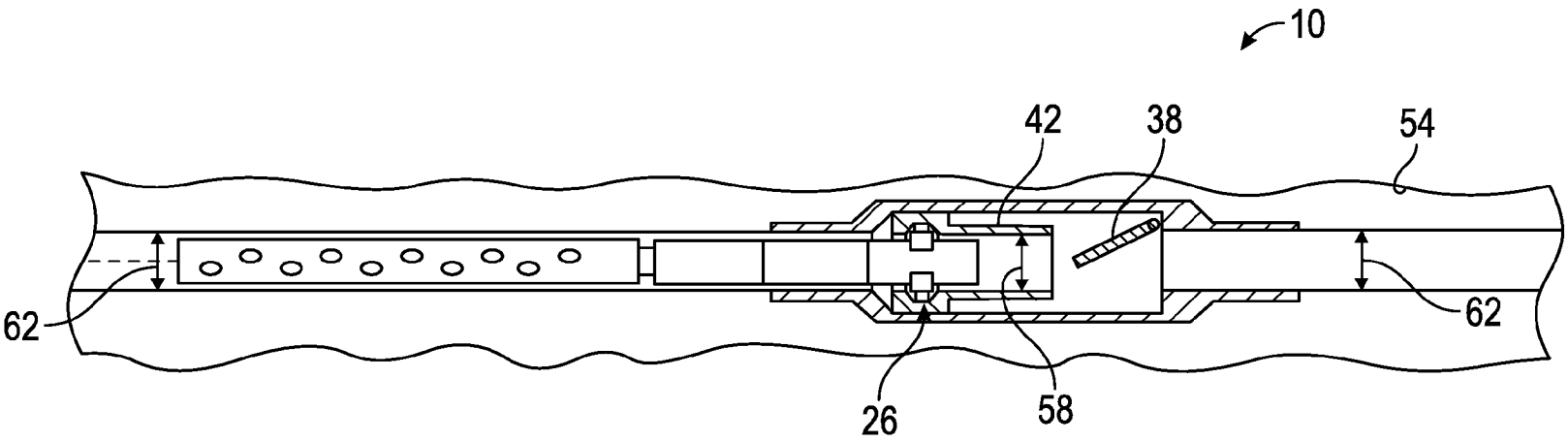
FIG. 2 depicts a magnified view of a portion of the completion of FIG. 1 in an alternate position.
Figure 3:
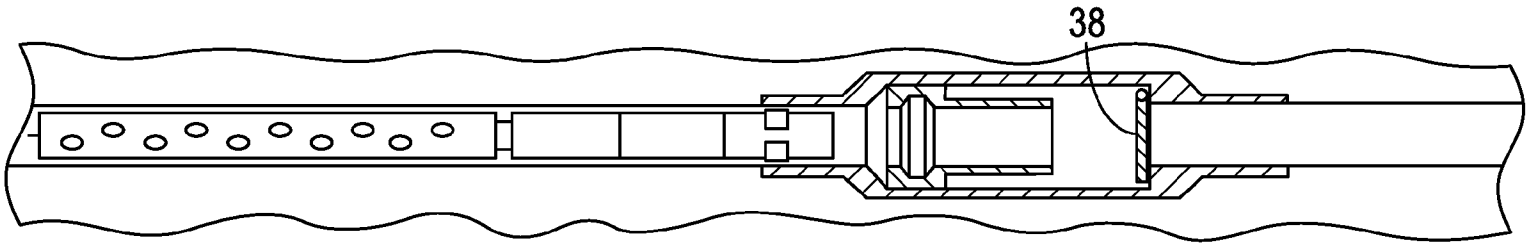
FIG. 3 depicts a magnified view of a portion of the completion of FIG. 1 with the valve shown in a closed position.
Figure 4:
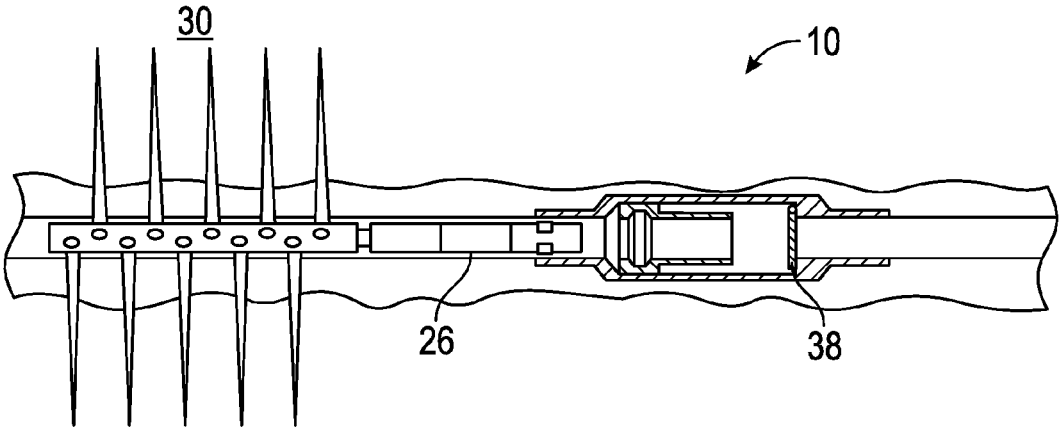
FIG. 4 depicts a magnified view of a portion of the completion of FIG. 1 after a tubular has been perforated.
Figure 5:
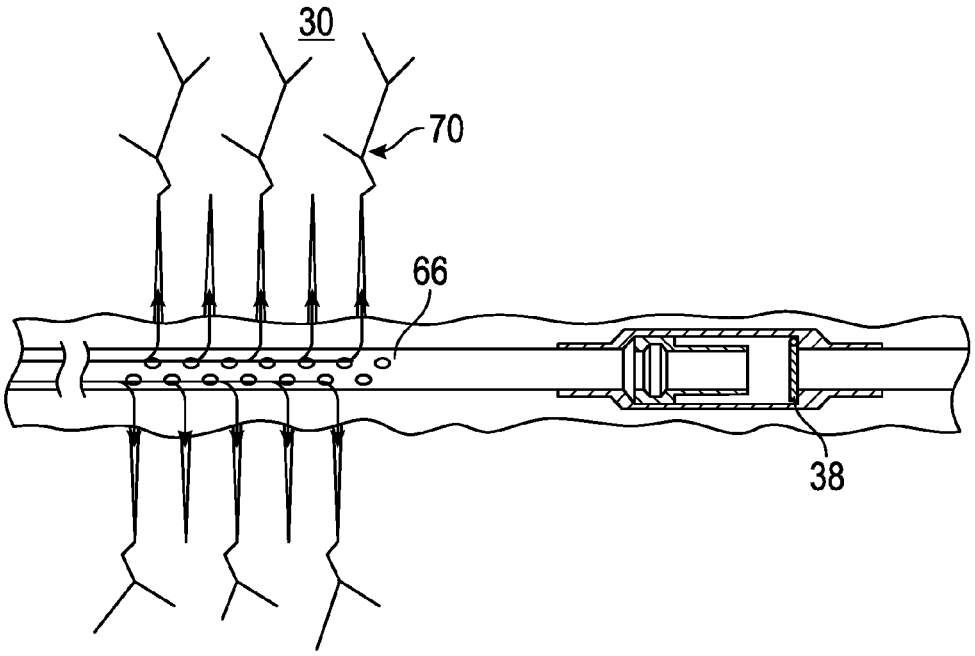
FIG. 5 depicts a magnified view of a portion of the completion of FIG. 1 after a formation has been fractured.

A detailed description of one or more embodiments of the disclosed apparatus and method are presented herein by way of exemplification and not limitation with reference to the Figures.

Referring to FIGS. 1-6, a completion disclosed herein is generally illustrated at 10. The completion includes a tubular 14 and at least one valve 18 in operable communication with the tubular 14. The at least one valve 18 is illustrated in the figures as being just one of the valves 18; however any practical number of the valves 18 could be employed in the completion 10. The tubular 14 as illustrated is a liner or casing in a borehole 20. The at least one valve 18 is configured to initially allow intervention therepast in a first direction indicated by arrow 22 in the Figure while being subsequently closable to fluid therepast in the first direction. Such intervention, for example, includes running of a wireline, coiled tubing, shifting tool or multi-tool 26 as illustrated herein. The valve 18 is configured to allow pressure to be built against the valve 18 while closed sufficient to actuate another tool 28 or treat a formation 30. The valve 18 is further configured to be subsequently reopenable immediately to allow flow therepast in a second direction indicated by arrow 34 without further intervention. In this embodiment, as indicated by the arrows 22 and 34, the second direction is opposite the first direction. The valve 18 is further configured to allow flow therepast in the first direction after a period of time without further intervention.

Figure 6:
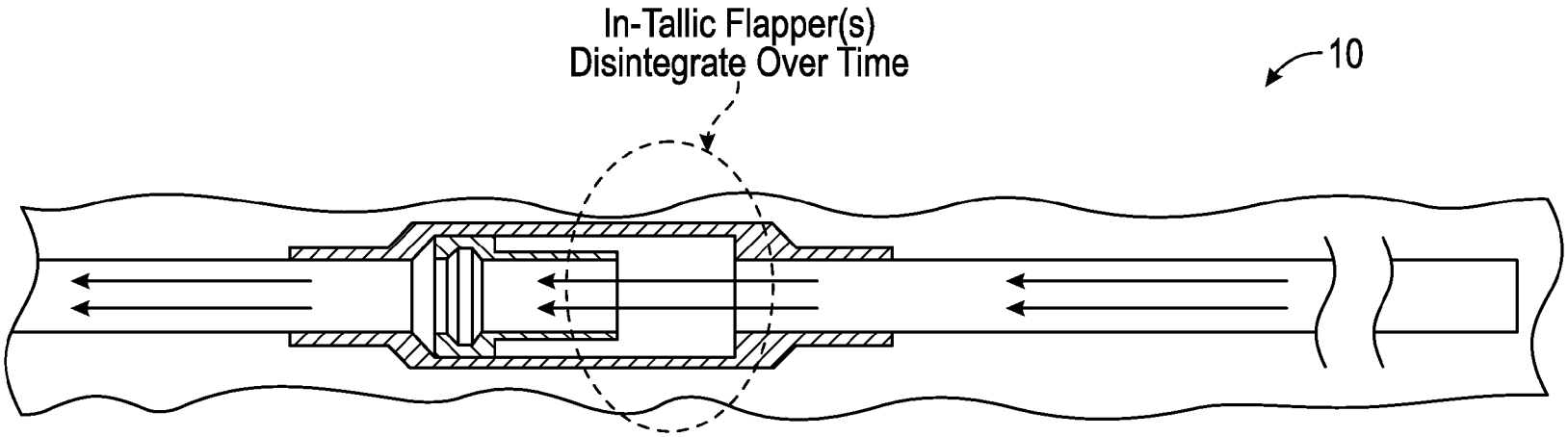
FIG. 6 depicts a magnified view of a portion of the completion of FIG. 1 after the flapper has been removed.

The embodiment of the valve 18 illustrated herein includes a movable portion 38 shown herein is a flapper, however, other embodiments are contemplated. The flapper 38 is biased toward the closed position and as such is reopenable immediately to flow in the second direction by the force of fluid flow in the second direction that overcomes the closing bias on the flapper 38. In this embodiment the valve 18 is reopenable to flow in the first direction after a period of time has passed after the flapper 38 has been closed. This reopening is due to disintegration or dissolution and removal of the flapper 38 as illustrated in FIG. 6.

In this embodiment a sleeve 42 maintains the flapper 38 in the open position (as shown in FIG. 1 only) until the sleeve 42 has shifted. The sleeve 42 is slidably sealably engaged with a housing 46 of the valve 18 by seals 50 prior to being shifted. The sleeve 42 and the seals 50 prevent fluid within the borehole 21 from reaching the flapper 38 until the sleeve 42 has been shifted. The foregoing structure allows an operator to control initiation of dissolution of the portion 38 of the valve 18 by preventing exposure of the portion 38 to a dissolving environment, such as borehole fluid for example, until the sleeve 42 has shifted. Thus, the tubular 14 can be run into a borehole 20 and cemented without dissolution of the flapper 38 having been initiated.

Components that define the valve 18, including the housing 46, the seals 50, the sleeve 42 and the flapper 38 in this embodiment are sized and configured to define a minimum radial dimension 58 (shown if FIG. 2 only) when the valve is open (either before having closed or after having reopened, pre or post dissolution of the flapper 38) that is no smaller than a minimum radial dimension 62 of the tubular 14 in either longitudinal direction from the valve 18. As such the valve 18 creates no impediment to interventions including running tools therepast, nor any restriction to the flow of fluid through the valve 18 that is greater than that of through the tubular 14 itself.

The embodiments disclosed herein include a plurality of the valves 18 positioned along the tubular 14 within the borehole 20. Each of the valves 18 is configured to close to downhole flow once shifted for at least a duration of time while being reopenable to allow uphole flow immediately, regardless of whether the valve 18 has been shifted or not. The multi-tool 26 is configured to separately shift each of the plurality of valves 18 and repeatedly perforate the lining 14 of the borehole 20 and to allow fracing of the formation 30 through the perforated lining 66 (FIG. 5 only) with pressure built against one or more of the valves 18 that are closed while the multi-tool 26 remains positioned within the borehole 20. As such, a plurality of zones 70 (with just one zone being illustrated in FIG. 5) can be fraced and the borehole 20 opened to production flow therethrough upon a single trip of the multi-tool 26 through the borehole 20. The plurality of zones in this embodiment being fraced sequentially in the second direction.

Referring to FIG. 6, shows the valve after a disintegrable or dissolvable flapper has been dissolved or disintegrated.

While the invention has been described with reference to an exemplary embodiment or embodiments, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the claims. Also, in the drawings and the description, there have been disclosed exemplary embodiments of the invention and, although specific terms may have been employed, they are unless otherwise stated used in a generic and descriptive sense only and not for purposes of limitation, the scope of the invention therefore not being so limited. Moreover, the use of the terms first, second, etc. do not denote any order or importance, but rather the terms first, second, etc. are used to distinguish one element from another. Furthermore, the use of the terms a, an, etc. do not denote a limitation of quantity, but rather denote the presence of at least one of the referenced item.

What is claimed is:

1. A method of completing a well, comprising:

maintaining a minimum radial dimension of at least one valve at no less than a minimum radial dimension of a tubular when the at least one valve is positioned within the tubular;

preventing exposure of a portion of the at least one valve from a dissolving environment until after shifting of a sleeve of the at least one valve;

closing the at least one valve;

pressuring up against the closed at least one valve in a first direction;

actuating a tool or treating a formation;

opening the at least one valve without intervention;

flowing fluid past the at least one valve in a second direction; and removing a movable portion of the at least one valve.

2. The method of completing a well of claim 1, further comprising running a second tool in the tubular past the at least one valve in the first direction and withdrawing the second tool past the at least one valve in the second direction.

3. The method of completing a well of claim 2, further comprising shifting the at least one valve with the second tool to allow the at least one valve to close.

4. The method of completing a well of claim 2, further comprising:

shifting a plurality of the at least one valve;

perforating a plurality of zones; and fracing the plurality of zones during a single running of the second tool within the tubular.

5. The method of completing a well of claim 2, further comprising withdrawing the second tool past a second of the at least one valve in the second direction;

closing the second of the at least one valve;

pressuring up against the closed second of the at least one valve in the first direction;

actuating another tool or treating a formation;

opening the second of the at least one valve without intervention; and flowing fluid past the second of the at least one valve in the second direction.

6. The method of completing a well of claim 1, further comprising perforating a portion of the tubular.

7. The method of completing a well of claim 1 wherein the removing is removing a portion of the at least one valve that allowed pressure to be built thereagainst without intervention.

8. The method of completing a well of claim 1 wherein the removing is dissolving a portion of the at least one valve that allowed pressure to be built thereagainst without intervention.

9. The method of completing a well of claim 1, further comprising isolating a portion of the at least one valve that allowed pressure to be built thereagainst from fluid within the tubular prior to closing the at least one valve.

10. The method of completing a well of claim 1, further comprising allowing flow past the at least one valve in the second direction without intervention after having had pressure built against the at least one valve.

11. The method of completing a well of claim 1, further comprising fracing a formation.

* * * * *